US010202980B2

(12) United States Patent
Koki et al.

(10) Patent No.: US 10,202,980 B2
(45) Date of Patent: Feb. 12, 2019

(54) CENTRIFUGAL COMPRESSOR APPARATUS AND METHOD FOR PREVENTING SURGE THEREIN

(71) Applicant: IHI Corporation, Tokyo (JP)

(72) Inventors: Tsuneo Koki, Tokyo (JP); Naoki Nishiyama, Tokyo (JP); Yuji Echizen, Tokyo (JP); Takashi Oyabu, Tokyo (JP); Tomonori Seki, Tokyo (JP); Masashi Moriguchi, Tokyo (JP)

(73) Assignee: IHI Rotating Machinery Engineering Co., Ltd., Tokyo (JP)

( * ) Notice: Subject to any disclaimer, the term of this patent is extended or adjusted under 35 U.S.C. 154(b) by 487 days.

(21) Appl. No.: 14/244,669

(22) Filed: Apr. 3, 2014

(65) Prior Publication Data

US 2014/0219820 A1 Aug. 7, 2014

Related U.S. Application Data

(63) Continuation of application No. PCT/JP2012/075513, filed on Oct. 2, 2012.

(30) Foreign Application Priority Data

Oct. 3, 2011 (JP) ..... 2011/218955

(51) Int. Cl.
*F04D 27/02* (2006.01)
*F04D 27/00* (2006.01)
(Continued)

(52) U.S. Cl.
CPC ..... *F04D 27/0223* (2013.01); *F04D 25/06* (2013.01); *F04D 27/001* (2013.01); *F04D 17/10* (2013.01); *F05D 2270/335* (2013.01)

(58) Field of Classification Search
None
See application file for complete search history.

(56) References Cited

U.S. PATENT DOCUMENTS 3,240,422 A * 3/1966 Pettersen ..... F04D 27/0207 415/1
4,156,578 A * 5/1979 Agar ..... F04D 27/001 415/1
(Continued)

FOREIGN PATENT DOCUMENTS

CN 1155630 A 7/1997
CN 102124230 A 7/2011
(Continued)

OTHER PUBLICATIONS

Extended European Search Report issued in corresponding application 12838757.8, completed Jan. 15, 2015 and dated Jan. 22, 2015.
(Continued)

*Primary Examiner* — Kenneth J Hansen
(74) *Attorney, Agent, or Firm* — Griffin and Szipl PC

(57) ABSTRACT

There is provided a centrifugal compressor apparatus including a centrifugal compressor that centrifugally compresses a gas, an electric motor that rotatably drives the centrifugal compressor, a current detector that detects a drive current I of the electric motor, and an exhaust valve that discharges a compressed gas to a lower pressure section. The centrifugal compressor apparatus (A) detects the drive current I at a sampling cycle ts, (B) updates, as a current threshold, in real time, a value "(moving average)−n×(standard deviation)" for which a plurality of drive currents measured in a sampling period tp serves as a population, where n is a positive number in the range of 3 to 4 and, (C) determines that surging has occurred when the exhaust valve is closed and the drive current I is below the current threshold X, and (D)
(Continued)

further opens the exhaust valve to discharge the compressed gas when determining that surging has occurred.

9 Claims, 9 Drawing Sheets

(51) Int. Cl.
*F04D 25/06* (2006.01)
*F04D 17/10* (2006.01)

(56) References Cited

U.S. PATENT DOCUMENTS

| | | | | |
|---|---|---|---|---|
| 4,164,033 | A * | 8/1979 | Glennon | F04D 27/0207 415/17 |
| 4,686,834 | A * | 8/1987 | Haley | F04D 27/02 62/209 |
| 4,940,391 | A | 7/1990 | Elms et al. | |
| 4,968,215 | A * | 11/1990 | Blotenberg | F04D 27/0207 415/27 |
| 5,355,691 | A | 10/1994 | Sullivan et al. | |
| 5,365,459 | A | 11/1994 | Perry | |
| 5,873,257 | A * | 2/1999 | Peterson | F04D 27/0261 62/129 |
| 5,947,680 | A | 9/1999 | Harada et al. | |
| 5,971,712 | A | 10/1999 | Kann | |
| 6,213,724 | B1 | 4/2001 | Haugen et al. | |
| 2002/0072876 | A1* | 6/2002 | Yeung | F04D 27/02 702/179 |
| 2010/0296914 | A1 | 11/2010 | Staroselsky et al. | |
| 2011/0093133 | A1 | 4/2011 | Turney et al. | |
| 2012/0121440 | A1* | 5/2012 | Powell | F04D 27/02 417/44.2 |

FOREIGN PATENT DOCUMENTS

| | | | |
|---|---|---|---|
| EP | 0 368 557 | A2 | 5/1990 |
| EP | 0 761 981 | A2 | 9/1996 |
| EP | 1 602 933 | A1 | 12/2005 |
| JP | 60-111093 | A | 6/1985 |
| JP | 62-93194 | U | 6/1987 |
| JP | 62-195492 | A | 8/1987 |
| JP | 1988-31292 | U | 2/1988 |
| JP | 64-394 | A | 1/1989 |
| JP | 2-181096 | A | 7/1990 |
| JP | 9-79180 | A | 3/1997 |
| JP | 11-62887 | A | 3/1999 |
| JP | 2000-029513 | A | 1/2000 |
| JP | 2000-199495 | A | 7/2000 |
| JP | 2001-501694 | A | 2/2001 |
| JP | 2001-82380 | A | 3/2001 |
| JP | 2002-276590 | A | 9/2002 |
| JP | 2003-122429 | A | 4/2003 |
| JP | 2004-316462 | A | 11/2004 |
| JP | 2005-16464 | A | 1/2005 |
| JP | 2005-61352 | A | 3/2005 |
| JP | 4191560 | B2 | 12/2008 |
| JP | 2010-204704 | A | 9/2010 |
| KR | 1997-0001514 | B1 | 2/1997 |
| KR | 10-0441719 | B1 | 7/2004 |

OTHER PUBLICATIONS

International Search Report issued in corresponding application No. PCT/JP2012/075513 completed Dec. 7, 2012 and dated Dec. 18, 2012.

English translation of Office Action issued in corresponding Chinese application 20120048810.3 dated Apr. 30, 2015.

English translation of Office Action issued in corresponding Korean application 10-2014-7005452 dated Sep. 1, 2015.

Office action issued in corresponding CN patent application 201610086128.3 dated Dec. 27, 2016 (no translation available; submitted for certification).

* cited by examiner

FIG. 9

(A)

| Q | Π |
|---|---|
| Q1 | Π1 |
| Q2 | Π2 |
| Q3 | Π3 |
| ⋮ | ⋮ |
| Qn | Πn |

(B)

| Q | Π |
|---|---|
| Q1 | aQ1+b |
| Q2 | aQ2+b |
| Q3 | aQ3+b |
| ⋮ | ⋮ |
| Qn | aQn+b |

CENTRIFUGAL COMPRESSOR APPARATUS AND METHOD FOR PREVENTING SURGE THEREIN

This is a Continuation Application in the United States of International Patent Application No. PCT/JP2012/075513 filed Oct. 2, 2012, which claims priority on Japanese Patent Application No. 2011-218955 filed Oct. 3, 2011. The entire disclosures of the above patent applications are hereby incorporated by reference.

TECHNICAL FIELD

The present invention relates to a centrifugal compressor apparatus using a centrifugal compressor and a method of preventing surging therein.

BACKGROUND ART

Surging that accompanies extreme pressure fluctuation and noise occurs in a low flow rate region in a centrifugal compressor used in a turbo compressor or a turbo refrigerator. When the centrifugal compressor is in a surging state, the compressor cannot stably operate and the life of the compressor is shortened. At worst, there is also a possibility that the compressor is damaged.

In view of it, various means for preventing the occurrence of surging were proposed in the past (for example, Patent Literatures 1 to 9).

Except for a particularly necessary case, the centrifugal compressor is abbreviated as the "compressor" and surging is abbreviated as "surge".

CITATION LIST

Patent Literatures

PTL 1: Japanese Patent Application Laid-Open No. 60-111093, "APPARATUS FOR PREVENTING SURGE IN AXIAL-FLOW COMPRESSOR"

PTL 2: Japanese Patent Application Laid-Open No. 62-195492, "APPARATUS FOR PREVENTING SURGING IN TURBO COMPRESSOR"

PTL 3: Japanese Patent Application Laid-Open No. 64-394, "APPARATUS FOR PREVENTING SURGING IN COMPRESSOR"

PTL 4: Japanese Patent Application Laid-Open No. 2000-199495, "METHOD AND APPARATUS FOR PREDICTING SURGING IN TURBO REFRIGERATOR"

PTL 5: Japanese Patent Application Laid-Open No. 2004-316462, "METHOD AND APPARATUS FOR CONTROLLING CAPACITY OF CENTRIFUGAL COMPRESSOR"

PTL 6: Japanese Patent Application Laid-Open No. 2005-16464, "COMPRESSION DEVICE"

PTL 7: Japanese Utility Model Application Laid-Open No. 62-93194, "SAFETY DEVICE FOR TURBO COMPRESSOR OR THE LIKE"

PTL 8: Japanese Patent No. 4191560, "TURBO REFRIGERATOR AND METHOD OF CONTROLLING THE SAME"

PTL 9: Japanese Patent Application Laid-Open No. 2002-276590, "APPARATUS FOR DETECTING SURGING OF COMPRESSOR"

SUMMARY OF INVENTION

Technical Problem a. Relationship Between Surge Prevention Control and Energy Saving In the related art, there has been generally used a method that uses an estimated performance curve or a measured surge line of a centrifugal compressor. The method forms a surge prevention line so that an operating point of a compressor does not exceed the surge prevention line when a flow rate is reduced, and promptly performs blow-off control or bypass control when the operating point of the compressor exceeds the surge prevention line, so as to prevent the compressor from being in a surging state.

However, since there is a case in which the characteristics of the compressor are changed due to operating environment or with time, an actual surge line is probably different from an estimated performance curve. For this reason, in the related art, it has been general that a test (surge test) intentionally causing surging is performed on the spot, and with respect to an actually measured surge line, a surge margin of about 10 to 15% is given on the larger flow rate side.

For this reason, since the capacity control range of the centrifugal compressor is reduced by the surge margin in the related art, there is a problem in that energy loss occurs at the time of a reduced flow rate operation with a small capacity (flow rate).

b. Means for Detecting Surging

It is known that the compressor does not work as a compressor when the compressor is in a surging state so that shaft power and the flow rate of the compressor is significantly reduced from the last operating state.

According to a method proposed so far as means for detecting this state, a surging state is determined by comparing a flow rate, the drive current of an electric motor for the compressor related with the flow rate, or a state quantity such as drive electric power or discharge pressure, with a preset value.

When pressure change is used, pressure is an integrated value of the flow rate of fluid flowing into and out of a pressure vessel. Accordingly, the monitoring of fluctuation in pressure is performed by the measurement of a flow rate, usually leading to a delay control system. There is a characteristic that the change in the pressure is inversely proportional to the size of the pressure vessel and is proportional to the flow rate. It is easy to use a pressure change, but the monitoring of a surging state is equivalent to the recording of the fluctuation in the flow rate of the compressor. Differential processing is needed twice in order to extract a small pressure amplitude signal at the time of the occurrence of surging, in a pressure measurement range. Accordingly, since a complicated digital signal processing technique is needed to appropriately detect a surging state, there is a problem in that the cost of the apparatus for detecting surging is increased.

When the change in a flow rate is used, differentiation of a flow rate is needed once. Accordingly, signal processing is easy as compared to when pressure is used. However, in contrast, there are also problems in that a lot of noise components (fluctuation) are included in the measurement result of a flow rate, it is difficult to remove the noise components, and the number of measurement points is increased when means for measuring a flow rate is provided, causing the increase in cost.

The drive current of the electric motor tends to be proportional to a flow rate in a narrow range under the condition of constant discharge pressure, the drive current can be used as alternative means for measuring a flow rate. However, the fluctuation in the drive current is large like a flow rate, and there is a possibility that malfunction occurs or surging cannot be detected if a threshold is not appropriately set.

c. Means for Deciding Surge Prevention Line

It is general that a surge line of the compressor is input (set) in advance according to the characteristics of the compressor.

However, when the characteristics of the compressor are changed due to operating environment or with time, a state of the compressor may unexpectedly leads to surging. In this case, it is difficult to continue to subsequently operate the compressor.

d. Surge Prevention Control Means

It is general that control for preventing the surging of a compressor is performed using a flow rate and discharge pressure or a pressure ratio.

However, since a plurality of measuring instruments is needed to measure a flow rate, cost is increased. For this reason, there is a case in which the drive current of the electric motor is used as alternative means. This is based on a fact that discharge pressure is constant and a flow rate is substantially proportional to the drive current of the electric motor near a surge prevention line.

However, there is a problem in that the drive current of the electric motor and a discharge flow rate have errors according to operating conditions. Further, regarding discharge pressure, since a surge line is changed when suction pressure is changed, it is preferable that a pressure ratio be used.

In the above-mentioned PTLs 1 to 6, a surge line or a surge prevention line is set in advance as a limit in which a surging state occurs, and a state is controlled on the basis of a pressure ratio, a change rate of a pressure ratio, a change rate of power, differential pressure, a flow rate, and the like so as not to exceed the surge line.

In PTLs 7 to 9, surging is detected on the basis of fluctuation in drive current, pressure, a flow rate, the speed of fluid, and the like.

As described above, when a surge prevention line is set in advance, with respect to an actually measured surge line, a margin (surge margin) of about 10 to 15% is conventionally given. For this reason, there is a problem in that a capacity control range of the centrifugal compressor becomes narrow by that margin.

Further, since a surge line is changed due to operating environment or secular change, there is a possibility that a state of the compressor unexpectedly leads to surging if a surge margin is not sufficiently large.

Furthermore, since the variation (fluctuation) in the flow rate or the drive current of the centrifugal compressor is large during the operation of the compressor, malfunction or the non-detection of surging easily occurs. For this reason, in the case of the means for detecting surging in the related art, detection delay from the occurrence of surging to the detection of surging is long (for example, 20 to 30 sec). Accordingly, it is not possible to avoid extreme vibration, pressure fluctuation, and a noise.

The present invention has been made to solve the above-mentioned problems. That is, an object of the present invention is to provide a centrifugal compressor apparatus and surging preventing method thereof in which: (1) a detection delay from the occurrence of surging to the detection of surging is short, and the generation of vibration, pressure fluctuation, and a noise can be prevented; (2) a small surge margin can be set to significantly widen a capacity control range of the centrifugal compressor; and (3) a surge line can be automatically updated so as to follow variation of operation characteristics caused by operating environment or secular change.

Solution to Problem

According to the invention, there is provided a centrifugal compressor apparatus comprising:

a centrifugal compressor that centrifugally compresses a gas;

an electric motor that rotatably drives the centrifugal compressor;

a current detector that detects a drive current of the electric motor;

an exhaust valve that discharges a compressed gas to a lower pressure section; and a surge prevention control device that controls the exhaust valve so as to prevent surging in the centrifugal compressor, wherein the surge prevention control device:

(A) detects the drive current at a sampling cycle;

(B) updates, in real time, as a current threshold, a value "(moving average)−n×(standard deviation)" for which a plurality of drive currents measured in a sampling period serves as a population, wherein the number "n" is a positive number in the range of 3 to 4;

(C) determines that surging has occurred, when the exhaust valve is fully closed or an opening degree of the exhaust valve is intermediate, and the drive current is below the current threshold; and (D) further opens the exhaust valve to discharge the compressed gas when it is determined that surging has occurred.

Further, according to the invention, there is provided a method of preventing surging in a centrifugal compressor apparatus, wherein a centrifugal compressor that centrifugally compresses a gas, an electric motor that rotatably drives the centrifugal compressor, a current detector that detects a drive current of the electric motor, and an exhaust valve that discharges a compressed gas to a lower pressure section are provided, the method comprising:

(A) detecting the drive current at a sampling cycle;

(B) updating, in real time, as a current threshold, a value "(moving average)−n×(standard deviation)" for which a plurality of drive currents measured in a sampling period serves as a population, wherein the number "n" is a positive number in the range of 3 to 4;

(C) determining that surging has occurred, when the exhaust valve is fully closed or an opening degree of the exhaust valve is intermediate, and the drive current is below the current threshold; and (D) further opening the exhaust valve to discharge the compressed gas when it is determined that surging has occurred.

Advantageous Effects of Invention

When the centrifugal compressor is in a surging state, the compressor does not work. Accordingly, at the same time of surging, the shaft power of the compressor is reduced, so that the surging state can be observed as the change of the drive current of the electric motor.

The drive current is not constant since the drive current changes in accordance with the operating state of the compressor. However, a statistical technique in which the number of samples included in 3σ (which is three times as large as the calculated standard deviation) corresponds to 99% or more in regard to the distribution and a standard deviation of samples is applied, so that the amount of fluctuation in the drive current can be estimated by the calculation of a standard deviation.

The present invention is based on such knowledge.

That is, according to the above-mentioned device and method of the present invention, the surge prevention control device (B) updates, in real time, as the current threshold a value, "(moving average)−n×(standard deviation)" for which a plurality of drive currents measured in the sampling period serves as a population, wherein the number "n" is a positive number in the range of 3 to 4, and (C) determines that surging has occurred when the exhaust valve is closed and the drive current is below the current threshold. Thereby, it is possible to reliably detect a surging phenomenon without being affected by the fluctuation (variation) in the drive current.

Further, it is confirmed in the embodied example that detection delay from the occurrence of surging to the detection of surging in this determining means is within 1 sec (for example, about 0.1 sec) in the embodied example. It is confirmed in the embodied example that vibration, pressure variation, and a noise can be avoided by (D) opening the exhaust valve to discharge the compressed gas when it is determined that surging has occurred.

Accordingly, unlike the related art, a large surge margin does not need to be set, so that (2) it is possible to significantly widen the capacity control range of the centrifugal compressor by setting a small surge margin.

Further, even though surging occurs, it is possible to stably operate the compressor by avoiding vibration, pressure variation, and a noise. Accordingly, it is possible to acquire the operating conditions of the compressor at the time of the occurrence of surging as data by making surging occur, and (3) it is possible to automatically update a surge line so as to follow the variation of operation characteristics caused by operating environment or secular change.

BRIEF DESCRIPTION OF DRAWINGS

FIG. 9 is a diagram illustrating the update of polygonal line data.

DESCRIPTION OF EMBODIMENTS

Figure 1A:
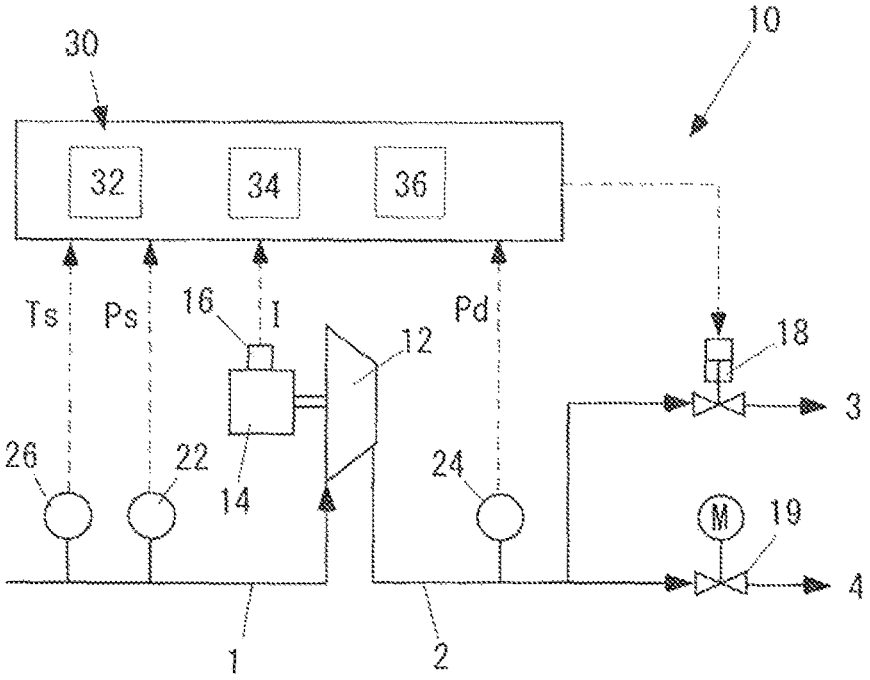
FIG. 1A is a diagram illustrating a centrifugal compressor apparatus according to an embodiment of the invention, and illustrates a case in which an exhaust valve is a blow-off valve.

A preferred embodiment of the invention will be described in detail below with reference to the accompanying drawings. Elements common to the respective drawings are denoted by the same reference numerals and the repeated description thereof will be omitted.

Figure 1B:
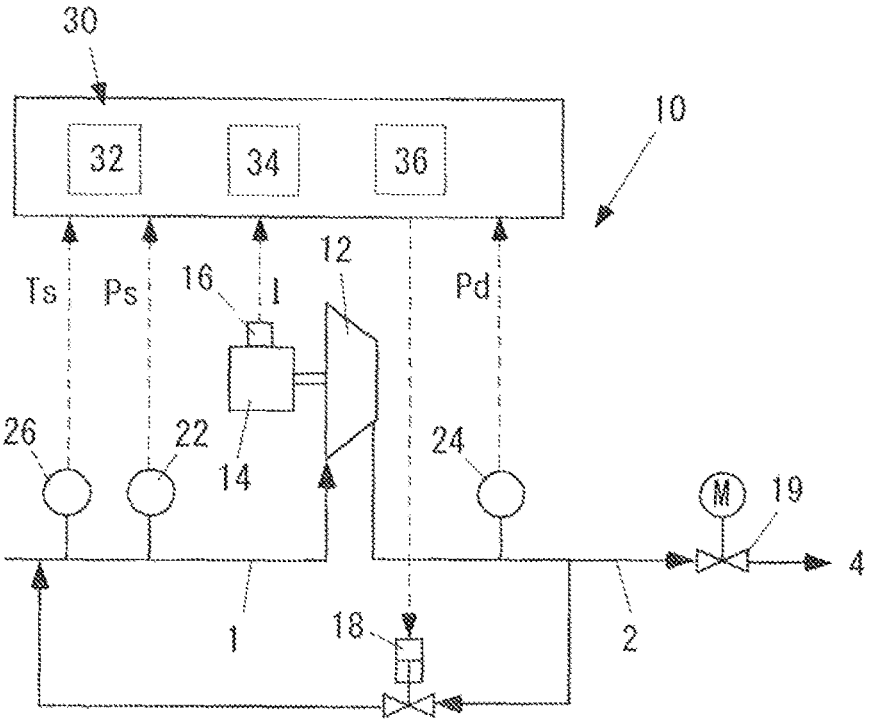
FIG. 1B is a diagram illustrating the centrifugal compressor apparatus according to the embodiment of the invention, and illustrates a case in which an exhaust valve is a bypass valve.

FIGS. 1A and 1B are diagrams illustrating a centrifugal compressor apparatus according to an embodiment of the invention.

In this example, a centrifugal compressor apparatus 10 includes a centrifugal compressor 12, an electric motor 14, a current detector 16, an exhaust valve 18, and a surge prevention control device 30.

The centrifugal compressor 12 centrifugally compresses a gas 1 (for example, air). The electric motor 14 rotatably drives the centrifugal compressor 12. The current detector 16 detects a drive current I of the electric motor 14. The exhaust valve 18 discharges a compressed gas 2 to a lower pressure section 3 of which pressure is lower than the compressed gas 2.

The exhaust valve 18 may be a blow-off valve or a bypass valve.

The exhaust valve 18 is a blow-off valve in the example of FIG. 1A, and the exhaust valve 18 is a bypass valve in the example of FIG. 1B. The bypass valve is a control valve that is provided in the middle of a pipe that makes communication between a discharge side and a suction side of the centrifugal compressor 12. In this case, the lower pressure section is the suction side of the centrifugal compressor 12.

In these drawings, the reference numeral 19 denotes a discharge valve that supplies the compressed gas 2 to a demander 4 of the gas 1. An opening degree of the discharge valve 19 is appropriately controlled in accordance with a demand from, for example, the demander 4.

The lower pressure section 3 is, for example, an outside air, and a blow-off silencer (not illustrated) may be provided therebetween. The exhaust valve 18 is fully closed during the normal operation of the centrifugal compressor 12.

In FIGS. 1A and 1B, the centrifugal compressor apparatus 10 further includes a suction manometer 22 and a discharge manometer 24 that detect suction pressure Ps and discharge pressure Pd of the centrifugal compressor 12, and a suction thermometer 26 that detects suction temperature Ts of the centrifugal compressor 12.

The surge prevention control device 30 is, for example, a computer (PC) and controls the exhaust valve 18 so as to prevent the surging of the centrifugal compressor 12. The control of the exhaust valve 18 may be ON/OFF control, or may be an operation for adjusting a flow rate.

The surge prevention control device 30 includes a power calculator 32, a flow rate calculator 34, and a pressure ratio calculator 36.

The power calculator 32 calculates drive power W of the electric motor 14 from the drive current I. The flow rate calculator 34 calculates a flow rate Q of the centrifugal compressor 12 from the drive power W, the suction pressure Ps, the discharge pressure Pd, and the suction temperature Ts. The pressure ratio calculator 36 calculates a pressure ratio Π from the suction pressure Ps and the discharge pressure Pd.

The surge prevention control device 30 operates as follows:

(A) The surge prevention control device 30 detects the drive current I at a sampling cycle ts.

(B) The surge prevention control device 30 updates a value "(moving average)−n×(standard deviation)", for which a plurality of drive currents I measured in a sampling period tp serves as a population, as a current threshold X in real time. Here, the value "n" is a positive number that is not smaller than 3 and not larger than 4.

(C) The surge prevention control device 30 determines that surging has occurred when the exhaust valve 18 is closed and the drive current I is smaller than the current threshold X.

(D) The surge prevention control device 30 opens the exhaust valve 18 to discharge the compressed gas 2 when determining that surging has occurred.

Figure 2:
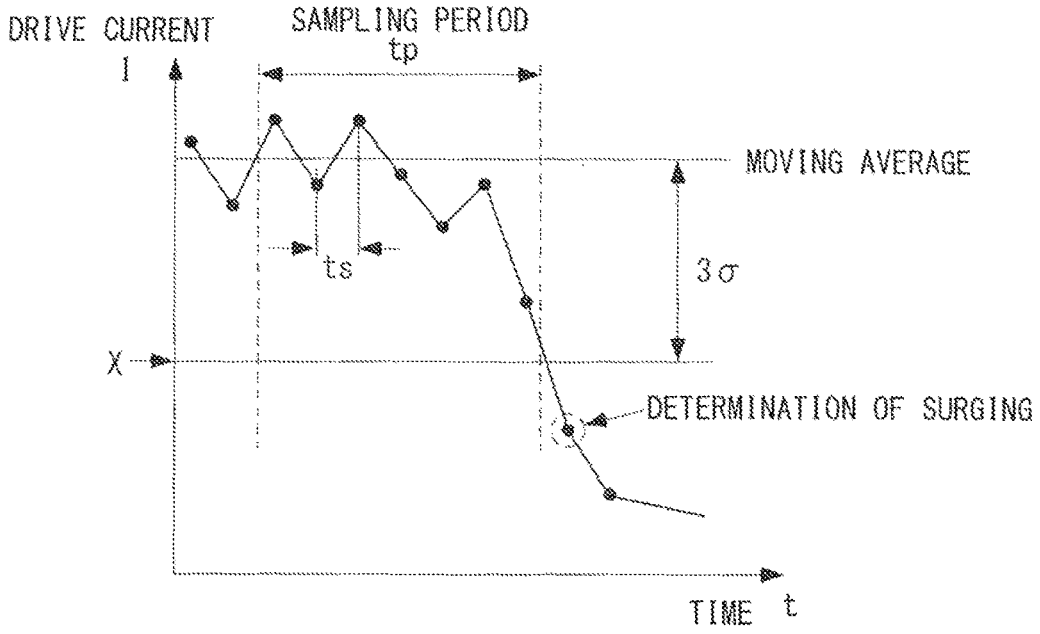
FIG. 2 is a diagram illustrating a method of the invention.

FIG. 2 is a diagram illustrating a method of the invention. The value "n" is three in FIG. 2.

In FIG. 2, a horizontal axis represents time t and a vertical axis represents the drive current I. The sampling cycle ts is 50 msec (0.05 sec) in an example to be described below. Further, the sampling period tp is about 25 sec in the example to be described below.

It is preferable that the sampling cycle ts be short as long as the control of the surge prevention control device 30 can follow the sampling cycle. However, the sampling cycle ts can be arbitrarily set in the range of 10 msec (0.01 sec) to 1 sec.

The sampling period tp can be arbitrarily set in the range of 1 sec to 100 sec, for example such that the number of samples of the above-mentioned population is preferably 100 or more. The number of the samples may be smaller than 100.

The method of the present invention using the above-mentioned device includes the respective following steps A to D.

In Step (A), the drive current I is detected at the sampling cycle ts.

In Step (B), a value "(moving average)−n×(standard deviation σ)", for which a plurality of drive currents I measured in the sampling period tp serves as a population, is updated as the current threshold X in real time. Here, the number "n" is a positive number in the range of 3 to 4.

In Step (C), it is determined that surging has occurred when the exhaust valve 18 is closed and the drive current I is lower than the current threshold X.

In Step (D), the exhaust valve 18 is opened to discharge the compressed gas 2 when it is determined that surging has occurred.

According to the above-mentioned apparatus and method of the present invention, the surge prevention control device 30 (B) updates a value "(moving average)−n×(standard deviation σ)", where the value "n" is a positive number in the range of 3 to 4 and for which a plurality of drive currents I measured in the sampling period tp serves as a population, as the current threshold X in real time, and (C) determines that surging has occurred when the exhaust valve 18 is closed and the drive current I is smaller than the current threshold X. Thereby, it is possible to reliably detect a surging phenomenon without being affected by the fluctuation (variation) in the drive current I.

As described above, the compressor 12 does not work when a state of the centrifugal compressor 12 leads to surging. Accordingly, surging and the shaft power of the compressor 12 are reduced, so that the surging can be observed as the change in the drive current I of the electric motor 14.

The drive current I of the electric motor 14 is not constant since the drive current I changes in accordance with an operating state of the compressor 12. However, when a statistical technique in which the number of samples included in 3σ (which is three times as large as the calculated standard deviation) corresponds to 99% or more in regard to the distribution and a standard deviation of samples is applied, the amount of fluctuation in the drive current I can be estimated by the calculation of a standard deviation σ.

That is, when it is assumed that a moving average and a standard deviation σ in the moving average calculation range are calculated and the current threshold X is equal to a value "(moving average)−n×(standard deviation σ)" where the value "n" is a positive number in the range of 3 to 4, it is considered that fluctuation in the drive current I exceeds the width of the usually generated fluctuation in the drive current I if the drive current I is smaller than the current threshold X. Accordingly, with a high probability, it can be regarded that there is a high possibility of the occurrence of a surging phenomenon, so that adjustment using manual intervention becomes unnecessary.

Since the reasons why the drive current becomes smaller than the current threshold X can be regarded as "the sudden fluctuation in data caused by external noises" and "the occurrence of surging" and exclude fluctuation in the measured data, it can be regarded that the probability of occurrence of the former can be 1% or less. That is, when it is assumed that the number of samples is 100, it can be regarded that the number of abnormal data is one. Now, if the sampling period is tp [sec], and the sampling cycle is ts [sec], when the occurrence time of a surging phenomenon is sufficiently longer than the sampling cycle ts, and a value "tp/ts" is larger than 100, "the sudden fluctuation in data" can be rejected all when the drive current is successively smaller than the current determination value two or more times. Accordingly, the cause of the occurrence of the event can be regarded as the occurrence of surging.

According to the confirmation that is based on this idea and that concerns current behavior at the time of the occurrence of surging, detection delay generated by this determining means from the occurrence of surging to the detection of surging was within 1 sec (for example, about 0.6 sec) in an embodied example.

Accordingly, from the embodied example to be described below, it was confirmed that this determining means can reliably detect the occurrence of surging with a detection delay of 1 sec or less when an appropriate sampling period tp and an appropriate sampling cycle ts are set.

However, a phenomenon in which the drive current I is smaller than the current threshold X occurs even when the exhaust valve 18 is suddenly opened. For this reason, in the present invention, a fact that the exhaust valve 18 is fully closed or an opening degree of the exhaust valve 18 is an intermediate value is used as a prerequisite for the determination of surging.

Here, the state of "fully opened" or "fully closed" generally means an opening area in which a limit switch (opening degree detector) works, but is not necessarily a value that corresponds to an opening degree of 100% or 0%.

Specifically, "fully opened" generally means an opening degree in the range of about 95% to 100%, but may be set to an opening of about 90%.

For example, a butterfly valve theoretically moves by an angle of 90°. However, there is also a method of using the butterfly valve in which an angle of 60° is defined as an opening of 100% so that the upper limit is set, when an angle of 0° relative to the flow is defined as "fully closed". Accordingly, "fully opened" can be defined as "the operational maximum opening degree".

Further, "fully closed" generally means an opening degree in the range of about 5% to 0%, but there is also a method of using IGV of the compressor in which an opening degree of 30% is defined as "fully closed".

Accordingly, like "fully opened", "fully closed" can be defined as "the operational minimum opening degree".

The intermediate opening degree means an opening state that is not a state of each of "fully opened" and "fully closed". That is, the intermediate opening degree in surge prevention control is "an opening degree from which the exhaust valve can be further opened" and means the state of substantially constant opening.

According to the design of the exhaust valve (blow-off valve) of the compressor, since discharge pressure falls below a rated specification point when the exhaust valve is fully opened, the exhaust valve is not usually operated so as to be fully opened while supplying air to a plant.

Accordingly, when surge prevention control is performed, the exhaust valve is fully closed or is further opened from the intermediate opening degree (an opening degree from which the exhaust valve can be further opened).

Further, an operating point of the compressor 12 may be monitored so that only when the operating point moves in a direction of approaching a preset surge line 5 (see FIG. 3), it is determined that surging has occurred. Thereby, it is possible to distinguish the surging from a blow-off operation performed by the exhaust valve 18.

Furthermore, an installed algorithm may compare a surge line stored in a control device of the compressor 12 with an operating point newly detected as surging. By this comparison, the algorithm does not determine that surging has occurred when the operating point is separated from the surge line 5 toward the larger flow rate side by a distance larger than the surge margin (Specifying of Surging Occurrence Point)

Further, according to the method of the present invention, the operation data of the centrifugal compressor 12 is stored for a constant time (the sampling period tp) at a constant cycle (the sampling cycle ts), and operation data at a surging occurrence point is obtained by referring to operation data at a time point traced back from the time point at which it is determined that surging has occurred.

That is, in the surge prevention control device 30, the operation data of the compressor 12 is recorded in a recording device (a recording buffer or the like) of the surge prevention control device 30 for a constant time at a constant cycle, and the operation record obtained at a time point slightly traced back (for example, traced back by 1 sec) from the time point at which surging is detected is referred to and is used as information of the time point at which surging occurs. Accordingly, an accurate surging occurrence point can be recorded.

(Automatic Update of Surge Line 5 Using Database of Surging Occurrence Point)

Further, according to the method of the present invention, the operation data at a surging occurrence point is stored in a database and the surge line 5 of the centrifugal compressor 12 is updated on the basis of this database.

When the operating environment of the compressor 12 is considered for a short time unit in the range of one hour to one day, many operating conditions are regarded as substantially constant. Accordingly, if one or more points of data obtained at the time of the occurrence of the surging of the compressor 12 can be stored in the control device, a surging line of the compressor 12 can be roughly estimated.

Surging occurrence points are recorded as samples and as surging occurrence database, appropriate samples are extracted from the data recorded in the database, and a surge line 5 is estimated by a polynomial approximation using a least-squares method or the like.

(Change of Surge Prevention Line 6)

Further, according to the method of the present invention, a surge prevention line 6 (see FIG. 3) is set as follows:

(E) With respect to the surge line 5, the surge prevention line 6 is set with a surge margin having a size so as not to be affected by a seasonal or secular change.

(F) When the operating point of the centrifugal compressor 12 is positioned on the lower flow rate side of the surge prevention line 6, the exhaust valve 18 is opened to discharge the compressed gas 2.

(G) The surge prevention line 6 is shifted toward the surge line 5 at a shift cycle so as to gradually approach the surge line 5. The shift cycle is one hour in the example to be described below, and the amount of shift is, for example, 0.001% of a rated flow rate.

(H) When it is determined that surging has occurred, the surge prevention line 6 is shifted to the larger flow rate side so that the surge prevention line 6 is reset so as to have the surge margin.

For example, it is known that the surge line 5 of the centrifugal compressor 12 compressing the air 1 differs between summer and winter. Accordingly, if the surge line 5 is set to be on a large flow rate side, there is a possibility that blow-off control works sufficiently before the surge line 5.

Accordingly, calculation for gradually shifting the surge prevention line 6 to a lower flow rate side is performed, so that the surge prevention line 6 gradually approaches the surge line 5 and finally reaches the surge line 5 during the operation of the compressor 12.

Accordingly, when the method of the present invention is used, surging can be reliably detected. Therefore, when surging is detected, it is possible to satisfy both stable operation and energy saving of the compressor 12 by shifting the surge prevention line 6 to the larger flow rate side a little so as to correct the operation to the optimum operation.

(Response to Change of Operating Condition)

It is ideal that the centrifugal compressor 12 is controlled, a horizontal axis representing a flow rate, and a vertical axis representing a pressure ratio.

Meanwhile, it is possible to improve cost performance by using the drive current I of the electric motor 14 instead of a flow rate. Items normally measured by the control device of the compressor 12 are the drive current I of the electric motor 14 and the discharge pressure Pd, and the suction pressure Ps or the suction temperature Ts can be easily measured as an option.

Since a suction pressure Ps is equivalent to the atmospheric pressure in the case of an installed centrifugal compressor 12 compressing the air 1, the suction pressure can be input as a constant in consideration of an altitude.

Further, it is possible to form the surge line 5 in appropriate consideration of the change of the operating condition of the compressor 12 by using the pressure ratio Π (=discharge pressure Pd/suction pressure Ps) on the vertical axis.

(Electric Power Converting Method of Drive Current I of Electric Motor 14)

The drive current I of the electric motor 14 and a shaft output W of the electric motor 14 do not have a completely linear relation. However, it is possible to improve the correlation between the drive current and an actual flow rate by converting the drive current I of the electric motor 14 into an equivalent shaft output by a characteristic table of the electric motor 14, and then using the converted equivalent shaft output in the calculation of a flow rate.

Embodied Example 1

1. Non-Dimensionalization of Surge Line 5

If the fluctuation in temperature and atmospheric pressure caused by the change of season is not corrected for a performance chart between the current I and the discharge pressure Pd, the surge line 5 is changed depending on a season or an operating place. It is possible to standardize the change of performance due to these conditions by converting the performance chart between the current I and the discharge pressure Pd into a performance chart (see FIG. 3) between the flow rate Q and the pressure ratio Π. The pressure ratio Π can be obtained from the suction pressure Ps and the discharge pressure Pd, and the flow rate can be obtained from the correction formula (1) of Formula 1.

[Formula 1]

$$Q(I, Ps, Pd, Ts) \approx \frac{\alpha I}{\mathrm{Ln}\left(\frac{Pd}{Ps}\right)} \cdot \frac{Ts + 273.15}{273.15} = \frac{\alpha I}{\mathrm{Ln}\Pi} \cdot \frac{Ts + 273.15}{273.15} \quad (1)$$

In this regard, α is a constant, Ps and Pd are absolute pressure, and Ts is suction temperature. When the centrifugal compressor 12 is an air compressor, "Ps≈1" and "Ts=outside air temperature" can be satisfied.

When α is appropriately corrected, the unit of Q can be converted into $Nm^3/hr$.

Calculation by the formula (1) is performed at the time of every scan and surge prevention control (FIC) is performed by the obtained flow rate Q and the obtained pressure ratio Π. The surge line 5 is represented by the flow rate Q and the pressure ratio Π.

Figure 3:
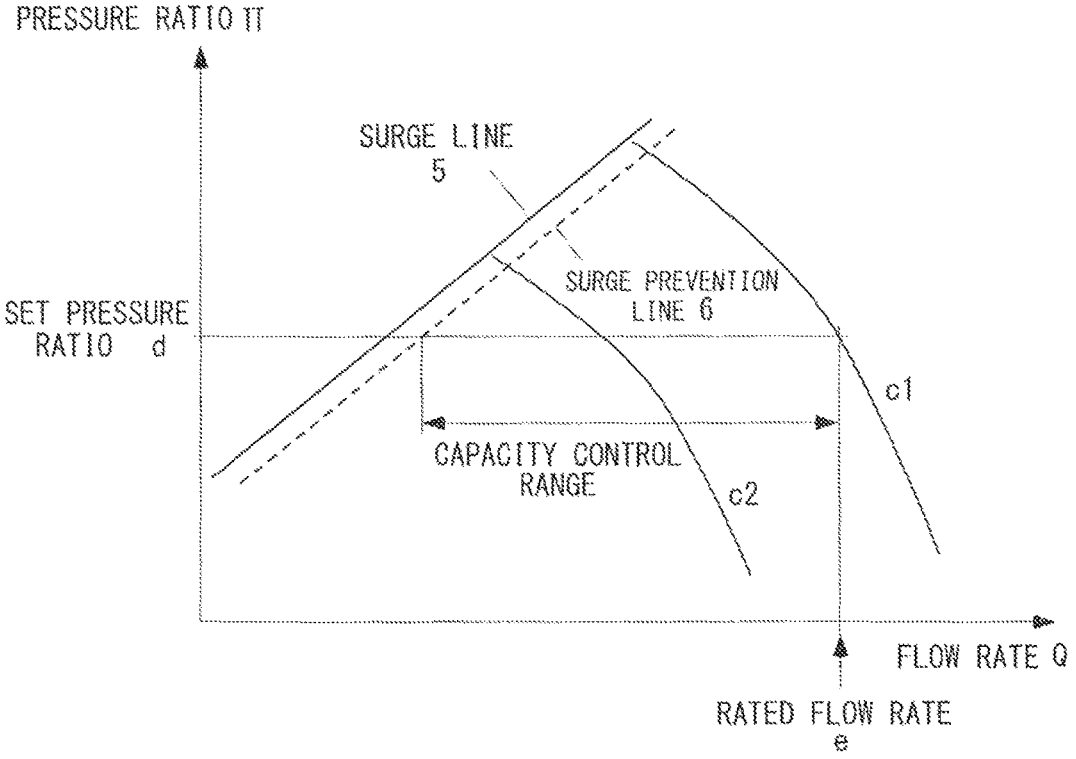
FIG. 3 is a diagram illustrating a surge line and a surge prevention line.

FIG. 3 is a diagram illustrating the surge line and the surge prevention line.

In FIG. 3, a horizontal axis represents a flow rate Q and a vertical axis represents a pressure ratio Π. Further, in FIG. 3, the reference numeral 5 denotes the surge line, the reference numeral 6 denotes the surge prevention line, the reference characters c1 and c2 denote the constant rotation speed lines of the centrifugal compressor 12, the reference character d denotes a set pressure ratio, and the reference character e denotes a rated flow rate. Furthermore, a double-headed arrow of FIG. 3 shows the capacity control range of the centrifugal compressor 12.

The surge prevention line 6 is set on the larger flow rate side of the surge line 5 so as to have a surge margin. In terms of a flow rate, the surge margin is set in the range of about 10 to 15% in the related art and is set in the range of 0 to 5% in the present invention.

When the centrifugal compressor 12 is an air compressor, "Ps≈1" can be satisfied as described above. In this case, the set pressure ratio d means set pressure.

According to the present invention, it is understood from FIG. 3 that the capacity control range of the centrifugal compressor 12 can be significantly widened by setting a small surge margin since a large surge margin does not need to be set unlike the related art.

2. Recording and Accumulation of Surging Occurrence Points

Figure 4:
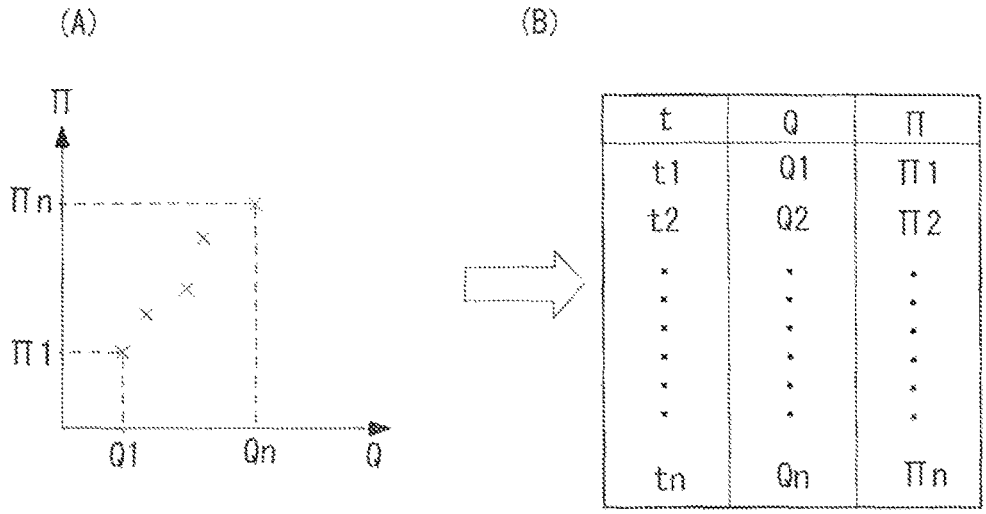
FIG. 4 is a diagram illustrating surge occurrence points and an example of surge data.

The part (A) in FIG. 4 is a diagram illustrating surge occurrence points, and the part (B) in FIG. 4 illustrates an example of surge data.

In the part (A) in FIG. 4, X marks represent points that are plotted using a flow rate and a pressure ratio at the time of the occurrence of surging. For the formation of an ideal surge line 5, flow rates and pressure ratios should be recorded while surging start pressure is changed. Accordingly, for the formation of a surge line 5 at as low surging as possible, as illustrated in the part (B) in FIG. 4, an approximate straight line is obtained from data of some flow rates and pressure ratios by linear interpolation.

Figure 5:
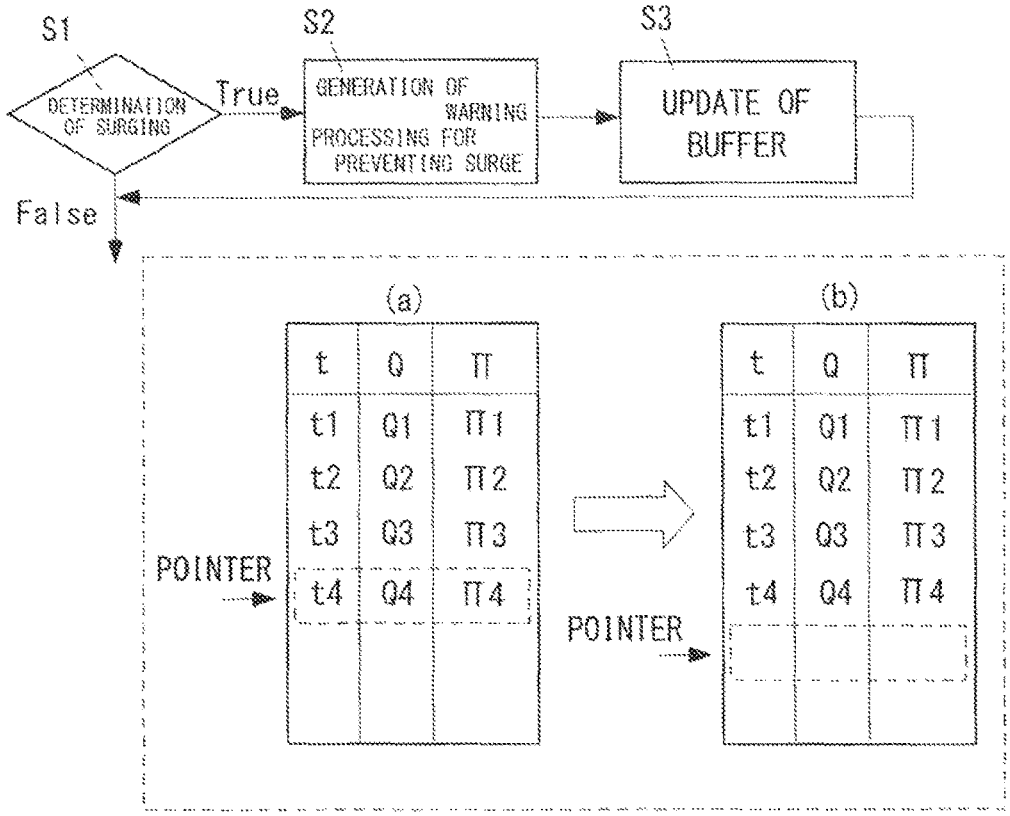
FIG. 5 is a diagram illustrating the flow of processing after the detection of surging.

FIG. 5 is a diagram illustrating the flow of processing after the detection of surging.

When surging is detected in "determination of surging" of S1 of FIG. 5 (true), the generation of warning and processing for preventing surge is performed in S2. Then, the update of the surge occurrence point recording buffer is performed in S3. As illustrated in (a) and (b) in a frame shown in FIG. 5 by a broken line, this update is performed by writing a time, a flow rate, and a pressure ratio in an address of the surge occurrence point recording buffer that is indicated by a pointer, and moving the pointer forward.

Figure 6:
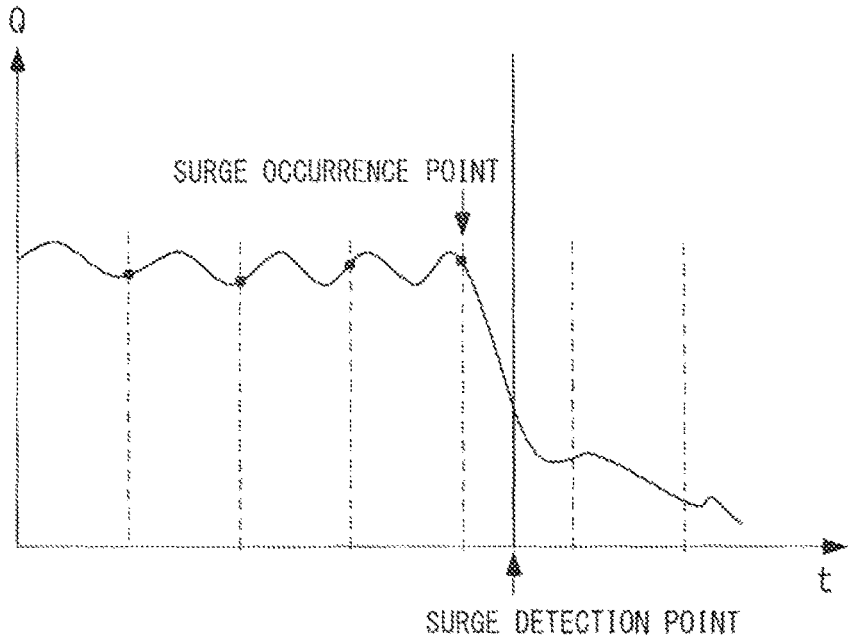
FIG. 6 is a method of processing a surge occurrence point.

FIG. 6 is a method of processing the surge occurrence point.

Since a flow rate and a pressure ratio are suddenly changed at the time of the occurrence of surging, stable data cannot be obtained in a method of recording an occurrence point at the moment of the detection of surging. In view of it, for using, as an occurrence point, a stable state in which surging does not yet occur, the sampling of flow rates Q and pressure ratios Π was performed at a regular interval (for example, an interval of 1 sec) as illustrated in FIG. 6, the sampling was stopped at the time of the detection of surging, and the final sampling data was used as an occurrence point.

Figure 7:
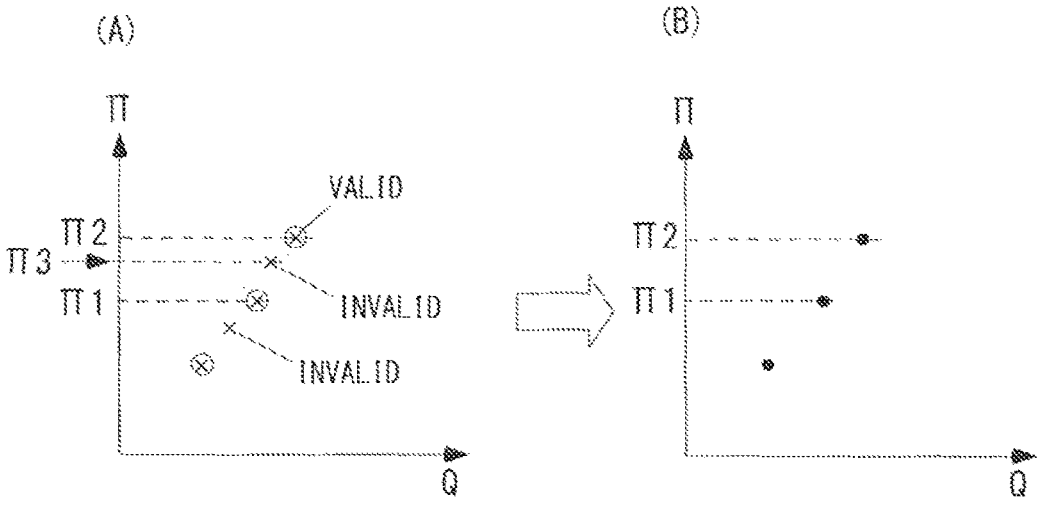
FIG. 7 is a diagram illustrating valid data extraction processing at the time of the reformation of the surge line.

The parts (A) and (B) in FIG. 7 are diagrams illustrating valid data extraction processing at the time of the reformation of the surge line.

The reformation of the surge line is linear approximation using a least-squares method. Accordingly, if recorded occurrence points are close to each other, the occurrence points are insufficient as base data for approximation. Accordingly, if newly recorded data is substantially separated from each other in terms of pressure base, the data is used as data valid for the reformation of the surge line. The parts (A) and (B) in FIG. 7 illustrate an algorithm that discriminates the valid data. If surge occurrence points of which pressure ratios are Π1, Π2, and Π3 are recorded in turns as illustrated in the part (A) in FIG. 7, the first data Π1 is determined as valid data since there is no data that is compared with the first data Π1. Since the next Π2 is separated from Π1, Π2 is also determined as valid data. However, since Π3 is positioned between Π1 and Π2 and is close to both Π1 and Π2, Π3 is determined as invalid data as illustrated in the part (B) in FIG. 7.

A method which automatically causes surging at the time of the use of the compressor 12 and performs processing for reforming the surge line in the background during operation is ideal as a method of collecting samples. However, when a large behavior at the time of surging is not suppressed by the surge prevention control, it is difficult to realize this method. In this case, surging is made to occur several times by a test for diagnosing the degradation of the compressor 12 so that samples are collected.

3. Estimation of Surge Line

Figure 8A:
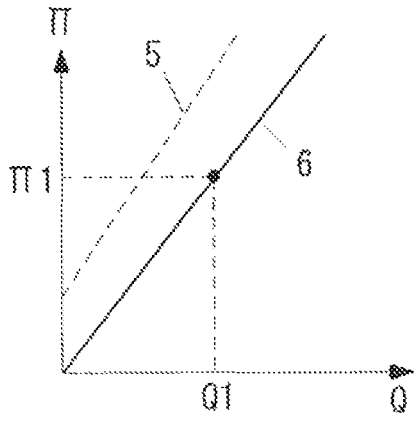
FIG. 8A is a diagram illustrating the reformation of the surge line when the number of times of the surging occurrence is one.
Figure 8B:
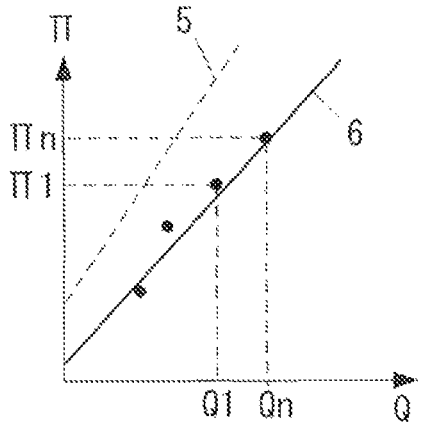
FIG. 8B is a diagram illustrating the reformation of the surge line using an approximate straight line.

FIGS. 8A and 8B are diagrams illustrating the reformation of the surge line 5, and the part (A) and (B) in FIG. 9 are diagrams illustrating the update of polygonal line data.

In the reformation of the surge line 5, an approximate straight line is obtained using a least-squares method. As illustrated in the part (A) and (B) in FIG. 9, the surge line 5 is stored in a polygonal line table and an initial set value is obtained from a performance curve of the compressor 12.

Here, the polygonal line table is a functional element that reads an input signal by using a numerical table defined in advance to output an appropriate value, and corresponds to a "converter" of JIS-Z8103.

Pressure ratios of this polygonal line table are obtained for all flow rate values by coefficients of a linear function that is obtained using a least-squares method, and pressure ratios are updated. The surge line 5 is reformed as illustrated in FIG. 8B by this processing.

Further, a straight line that passes through the origin and the occurrence point as illustrated in FIG. 8A is obtained when the number of the occurrences of surging is one.

4. Surging Detection Function

In the method of the present invention, as illustrated in FIG. 2, a value obtained by subtracting a value three times as large as the standard deviation σ from a moving average value is used as the current threshold X, so that a highly versatile surging detection function is realized.

Further, in the method in the related art, it was not possible to clearly distinguish surging from the reduction of a current that is caused by the sudden increase of flow rate demand or a forcible no-load operation. In view of it, according to the method of the present invention, at the time of forcible no-load operation (the opening of the exhaust valve 18), a surging determination function is made invalid, and in addition, surging determination is made on the basis of whether or not pressure advances toward the surge line 5 (upward tendency or downward tendency) when the drive current I is below the current threshold X. These two processes are employed.

5. Collection of Surge Data

Recall data obtained before and after the occurrence of surging is automatically collected as surge data with analog input/output values being targets.

When it is determined that surging has occurred, sampling data that was sampled before surging is written in the first half of a surging-recording buffer from the recording buffer, and processing for performing sampling by using the subsequent area until the number of data reaches N_log is started. When the number of data reaches N_log, sampling is ended and the data can be stored in a flash memory.

Here, "N_log" is a variable.

As means for estimating a correct surging occurrence point when it is determined that surging has occurred, measured values (a population of measured values) recorded in a calculator at fixed time intervals are used so as to adopt, as "data immediately before the occurrence of surging", data at the time point traced back by a fixed time (about 1 sec) from the time point at which it is determined that surging has occurred.

The purpose of collecting surge data is to accurately grasp the operating state of the compressor at a time point at which surging has occurred and to use the operating states as basic data for data analysis.

"Performing sampling until the number of data reaches N_log" is an act that records samples in the recording device of the calculator until the number of samples reaches "N_log".

Since the number of samples that can be recorded is limited, "N_log" is used as the name of number setting of an upper limit in order to limit quantity. When the number of recorded samples reaches an upper limit, processing for overwriting and deleting data from older data is performed.

Figure 10:
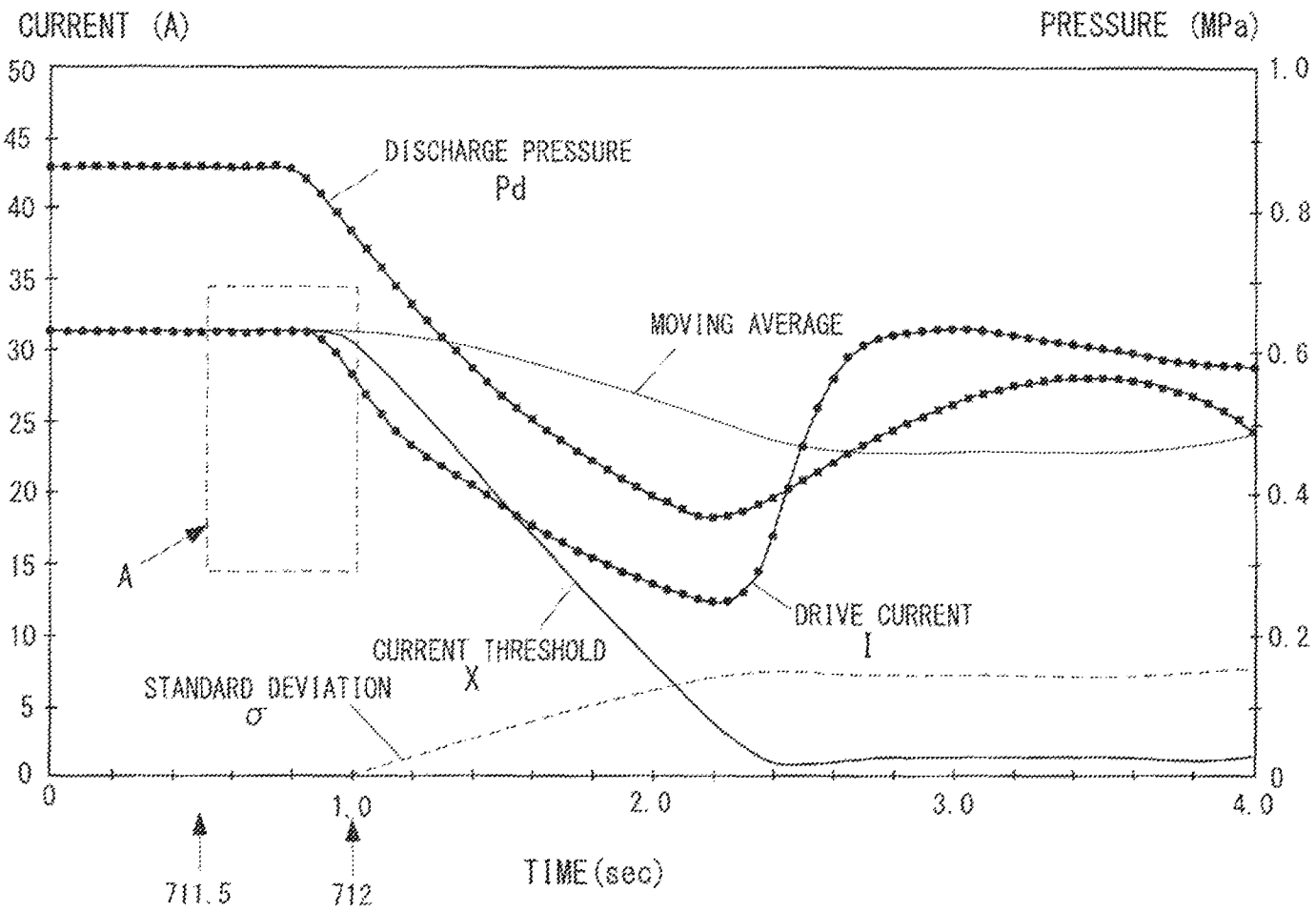
FIG. 10 is a diagram illustrating an embodied example of the present invention.

FIG. 10 is a diagram illustrating an embodied example of the present invention.

In FIG. 10, a horizontal axis represents time (sec), a left vertical axis represents a current (A), and a right vertical axis represents pressure (MPa). Further, curves of FIG. 10 represent the discharge pressure Pd, the drive current I, the moving average of the drive current I, the standard deviation σ, and the current threshold X.

Furthermore, in this example, a sampling cycle ts was 50 msec and a sampling period tp was 25 sec.

In this example, when the discharge pressure Pd is gradually reduced from about 0.86 MPa to about 0.25 MPa, the drive current I is reduced with this reduction and the moving average and the current threshold X are also reduced.

Figure 11:
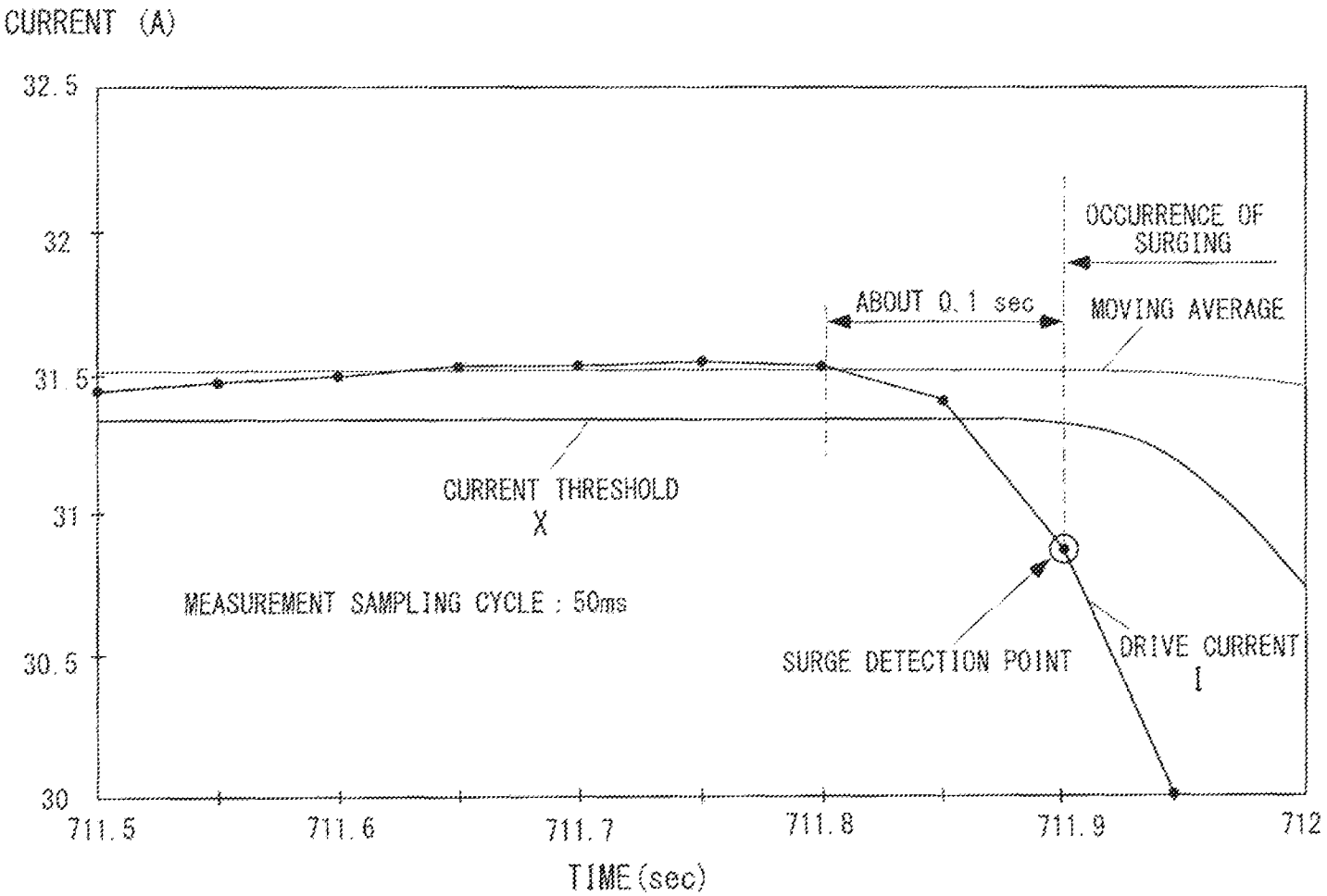
FIG. 11 is an enlarged view of a portion A of FIG. 10.

FIG. 11 is an enlarged view of a portion A of FIG. 10. This range is a range of 0.5 to 1 sec in FIG. 10, and corresponds to a range of 711.5 to 712 sec of measured time.

Meanwhile, in this measurement result, the moving average of the drive current I is about 31.5 A and a value (3σ) three times as large as the standard deviation σ is about ±0.2 A, and the normal operating range of the drive current I is 31.5±0.2 A.

In FIG. 11, the reduction of the drive current I is started at 711.8 sec, and becomes smaller than the current threshold X at 711.9 sec and it is determined that surging has occurred. Accordingly, time from the start of the reduction of the drive current I to the determination of surging (about 711.9 sec) was about 0.1 sec.

Therefore, according to the present invention, from this embodied example, it was confirmed that it is possible to reliably detect the occurrence of surging with a detection delay of 1 sec or less.

Further, in this example, there was no noise caused by surging, and vibration or pressure fluctuation was also not detected.

Furthermore, in this embodied example, the followings were confirmed as conditions necessary to reliably detect surging.

Sampling cycle: 200 ms or less. This is the time necessary to accurately detect surging.

Moving average interval: 6 sec to 2 min. Since it is important that the moving average interval is sufficiently slower than dynamic characteristics of the compressor, 6 sec or more is needed. Further, since it is important that the moving average interval is sufficiently faster than dynamic characteristics of a plant, 2 min or less is sufficient.

Standard deviation threshold: three times (3σ). 3σ corresponds to about 99.865% in the standard normal probability distribution.

The above-mentioned present invention has the following characteristics.

(1) In the determination of the reduction of the drive current I of the electric motor 14, a determination value (current threshold X) is changed dynamically in accordance with the operating states of the compressor 12 by using the moving average and the standard deviation σ in the moving average calculation range.

Further, the reduction of the drive current I of the electric motor 14 is detected, and it is determined that surging has occurred by the comparison with the operating point of the compressor 12.

Furthermore, since the duration of fluctuation in the drive current I is not used as the criterion for the determination, the time taken until the determination of surging is very short (about 1 sec or less).

Since a statistical technique is used to calculate the determination value (current threshold X), the probability concerning determination that surging has occurred is very high as long as the compressor 12 is normally operated.

(2) A data buffer that accumulates data for calculating the moving average is used so that an operating state obtained at the time point traced back by a prescribed time is used as data at the time of the occurrence of surging.

By using this method, it is possible to accurately record a surging occurrence point.

(3) The drive current I of the electric motor 14 is correlated with a flow rate, but is affected by the operating states of the compressor 12 (the suction temperature Ts, the suction pressure Ps, the discharge pressure Pd, and the like). Accordingly, there is no guarantee that a relationship between a current and a flow rate is necessarily stable for a year.

For this reason, the formula (1) for converting the drive current I into the flow rate Q is used. Accordingly, even though the operating state of the compressor 12 is changed, a relation between the drive current I and the flow rate Q is not changed.

(4) A database (a group in a statistical terminology) of the surging occurrence points is stored in the recording device of the control device, and the surge line 5 is estimated using a least-squares method in a method of calculating a correlation function by using samples appropriately extracted from the group.

If a method of extracting samples from the group is appropriate, it is possible to automatically obtain the same probability as in the case of obtaining the surge line 5 by performing a surge test.

(5) In regard to a margin between the surge line 5 and the surge prevention line 6, if surging does not occur for a long time, it can be evaluated that the surging margin is sufficient. Accordingly, the margin can be adjusted so as to be reduced. Therefore, if the above-mentioned shift cycle is set to, for example, one hour and the amount of shift is set to, for example, 0.001% per hour, automation can be achieved.

When surging occurs as a result of the reduction of the surge margin, the reduced amount of the surge margin is considered as a problem. Accordingly, a system that automatically returns the margin to the original margin by adding +1% or the like to the margin may be provided.

By this method, it is possible to automatically adjust the surge margin to an optimum value. In this case, it is estimated that the surge margin has a fluctuation range of, for example, 3 to 7%.

(6) Since the surge line 5 used in the control is obtained as values of the surging occurrence points of the compressor 12 for which the change of the operating state has been corrected, the surge line 5 has dimensionlessness degree higher than that of a surge line 5 that simply uses the drive current I and the flow rate Q, and the reliability of the surge line 5 is high.

In addition, it is possible to safely avoid surging by the response speed and certainty of the detection of the occurrence of surging even if the surge line 5 has an error.

Accordingly, it is possible to reduce the margin of a flow rate, which was provided between the surge line 5 and the surge prevention line 6 and was in the range of 10 to 15% in the related art, to the utmost limit (0 to 5%).

As a result, as compared to the method in the related art, the throttle limit of the compressor 12 can be increased by 5% or more, the number of times of load/no-load operation can be reduced when a low-pressure operation and an ON/OFF control operation is performed, so that an energy saving operation can be performed.

The following effects a to e are obtained by the above-mentioned present invention.

a. It is possible to detect the surging of the compressor 12 within about 1 sec (before a person perceives surging).

As a result, it is possible to promptly perform blow-off control after the detection of surging, and to safely avoid a surging phenomenon without causing the increase of the vibration of the shaft that is generated together with the occurrence of surging.

In other words, so far, there has been no means capable of reliably avoiding surging even though surging occurs. Accordingly, a margin between the surge line 5 and the surge prevention line 6 was secured by about 10 to 15%, and operation is performed such that a state cannot enter surging even though a measurement error was generated.

In contrast, according to the method of the present invention, the compressor 12 can be stably operated without being adversely affected even though a surge margin is reduced to zero, that is, the utmost limit. Accordingly, it is possible to perform control of throttling by extra 5% or more as compared to the related art, and to satisfy both the improvement in the control stability on the low flow rate side and energy saving.

b. It is possible to distinguish the sudden increase of demand for air (including a forcible no-load operation) from surging.

Since surging is appropriately determined even though not only an internal signal of the control device but also disturbance in a facility of a demander is given, it is possible to stably operate the compressor 12.

c. It is possible to accurately estimate the surge line.

Surging occurrence points can be accurately specified to thereby obtain high reliability of the surge line 5 that is obtained by extracting samples from the database of the surging occurrence points and using a least-squares method.

d. An algorithm for gradually moving the surge prevention line 6 to the lower flow rate side and a reliable algorithm for determining surging are installed. Accordingly, even if the surge line 5 is changed, it is possible to always make the surge prevention line 6 gradually approach the surge line 5. Further, a margin (surge margin) from between the surge line 5 to the surge prevention line 6 that needed to be in the range of 10 to 15% in the related art can be reduced to the range of 0 to 5%. Therefore, it is possible to widen a reduced flow rate operating range by a width in the range of about 5 to 15% as compared to the related art.

As a result, the reduced flow rate range can be significantly widened, so that the energy saving of the compressor 12 and the stability of pressure control are improved.

e. It is possible to deal with the change of operating conditions of the compressor 12.

Since the surge prevention line 6 can be substantially accurately and automatically updated, surge prevention control for the compressor 12 can be performed by converting the drive current I of the electric motor 14 into a flow rate and by using the flow rate and the pressure ratio.

As a result, the non-dimensionlessness degree becomes high as compared to a control method that simply uses the drive current I of the electric motor 14 and discharge pressure, so that the reliability of the surge prevention control becomes high in cooperation with the certainty of the determination of surging.

The present invention is not limited to the above-mentioned embodiment, is specified by the description of claims, and includes all modifications made within meaning or a scope equivalent to the description of claims.

REFERENCE SIGNS LIST

1: gas
2: compressed gas
3: lower pressure section
4: demander
5: surge line
6: surge prevention line
10: centrifugal compressor apparatus
12: centrifugal compressor (compressor)
14: electric motor
16: current detector
18: exhaust valve
19: discharge valve
22: suction manometer
24: discharge manometer
26: suction thermometer
30: surge prevention control device
32: power calculator
34: flow rate calculator
36: pressure ratio calculator

The invention claimed is:

1. A centrifugal compressor apparatus comprising:

a centrifugal compressor arranged to centrifugally compress a gas;

an exhaust valve provided in a pipe that makes communication between a discharge side of the centrifugal compressor and a section where pressure is lower than on the discharge side; and a surge prevention controller operably connected to control the exhaust valve, wherein the surge prevention controller is operably connected to (a) monitor an operating point of the centrifugal compressor, (b) based on a previously set and stored surge line, set a first surge prevention line on a larger side, in a flow rate, of the set and stored surge line of the centrifugal compressor, (c) calculate the flow rate and a pressure ratio of the centrifugal compressor;

(d) open the exhaust valve when the surge prevention controller determines that the monitored operating point of the centrifugal compressor is positioned on a lower side, in the flow rate, of the first surge prevention line set by the surge prevention controller; and (e) when determining that surging has occurred, shift the first surge prevention line to a larger side in the flow rate as a second surge prevention line, wherein the operating point, the surge line, and the first and second surge prevention lines are expressed in a two-dimensional coordinate system including a coordinate axis of the calculated flow rate and a coordinate axis of the calculated pressure ratio; and (f) shifting the first surge line toward the set surge line at a shift cycle so that the first surge prevention line gradually approaches the set surge line.

2. A method of preventing surging, the method comprising the steps of:

(A) monitoring an operating point of the centrifugal compressor;

(B) based on a previously set and stored surge line, setting a first surge prevention line on a larger side, in a flow rate, of the set and stored surge line of the centrifugal compressor;

(C) calculating the flow rate and a pressure ratio of the centrifugal compressor;

(D) opening an exhaust valve provided in a pipe operably connected to communicate between a discharge side of the centrifugal compressor and a section where pressure is lower than on the discharge side, when a surge prevention controller determines that the monitored operating point on the centrifugal compressor is positioned on a lower side, in the flow rate, of the first surge prevention line set by the surge prevention controller;

(E) when determining that surging has occurred, shifting the first surge prevention line to a larger side in the flow rate to be set as a second surge prevention line, and wherein the steps (A) to (E) are performed by the surge prevention controller, and the operating point, the surge line, and the first and second surge prevention lines are expressed in a two-dimensional coordinate system including a coordinate axis of the calculated flow rate and a coordinate axis of the calculated pressure ratio: and (F) shifting the first surge line toward the set surge line at a shift cycle so that the first surge prevention line gradually approaches the set surge line.

3. The method of preventing surging according to claim 2, wherein the pipe makes communication between the discharge side and the section that is a suction side of the centrifugal compressor.

4. The method of preventing surging according to claim 2, wherein the first surge prevention line is set to have a surge margin from the set surge line, and the surge margin is in a range of 10 to 15% or in a range of 0 to 5% in terms of the flow rate.

5. A centrifugal compressor apparatus comprising:

a centrifugal compressor arranged to centrifugally compress a gas;

an electric motor operably connected to rotatably drive the centrifugal compressor;

a current detector operably connected to detect a drive current of the electric motor;

an exhaust valve operably connected to discharge a compressed gas to a lower pressure section; and a surge prevention controller operably connected to control the exhaust valve, wherein the surge prevention controller (A) is arranged to detect the drive current at a sampling cycle;

(B) is configured to update, in real time, as a current threshold, a value "(moving average)−n×(standard deviation)" for which a plurality of drive currents measured in a sampling period serves as a population, wherein the number "n" is a positive number in the range of 3 to 4;

(C) is configured to determine that surging has occurred, when the exhaust valve is fully closed or an opening degree of the exhaust valve is intermediate, and the drive current is below the current threshold (D) is operably connected to further open the exhaust valve to discharge the compressed gas when it is determined that surging has occurred, (E) is operably connected to monitor an operating point of the centrifugal compressor, (F) is operably connected to, based on a previously set and stored surge line, set a first surge prevention line on a larger side, in a flow rate of the set and stored set surge line of the centrifugal compressor;

(G) is operably connected to calculate the flow rate and a pressure ratio of the centrifugal compressor;

(H) is operably connected to open the exhaust valve to discharge the compressed gas when the surge prevention controller determines that the monitored operating point of the centrifugal compressor is positioned on a lower side, in the flow rate, of the first surge prevention line set by the surge prevention controller;

(I) is operable to shift the first surge prevention line toward the set and stored surge line at a shift cycle so that the first surge prevention line gradually approaches the set surge line; and (J) is operable to, when determining that surging has occurred, shift the first surge prevention line to a larger side in the flow rate as a second surge prevention line, and wherein the operating point, the surge line, and the first and second surge prevention lines are expressed in a two-dimensional coordinate system including a coordinate axis of the calculated flow rate and a coordinate axis of the calculated pressure ratio.

6. The centrifugal compressor apparatus according to claim 5, further comprising:

a suction manometer and a discharge manometer arranged to detect suction pressure and discharge pressure of the centrifugal compressor, respectively; and a suction thermometer arranged to detect suction temperature of the centrifugal compressor, wherein the surge prevention controller includes a power calculator operably connected to calculate drive power of the electric motor from the drive current of the electric motor;

a flow rate calculator operably connected to calculate the flow rate of the centrifugal compressor from the drive power, the suction pressure, the discharge pressure, and the suction temperature; and a pressure ratio calculator operably connected to calculate a pressure ratio from the suction pressure and the discharge pressure.

7. A method of preventing surging in a centrifugal compressor apparatus, wherein a centrifugal compressor that centrifugally compresses a gas, an electric motor that rotatably drives the centrifugal compressor, a current detector that detects a drive current of the electric motor, and an exhaust valve that discharges a compressed gas to a lower pressure section are provided, the method comprising the steps of:

(A) detecting the drive current at a sampling cycle;

(B) updating, in real time, as a current threshold, a value "(moving average)−n×(standard deviation)" for which a plurality of drive currents measured in a sampling period serves as a population, wherein the number "n" is a positive number in the range of 3 to 4;

(C) determining that surging has occurred, when the exhaust valve is fully closed or an opening degree of the exhaust valve is intermediate, and the drive current is below the current threshold;

(D) further opening the exhaust valve to discharge the compressed gas when it is determined that surging has occurred;

(E) monitoring an operating point of the centrifugal compressor, (F) based on a previously set and stored surge line, setting a first surge prevention line on a larger side, in a flow rate, of the set and stored set surge line of the centrifugal compressor;

(G) calculating the flow rate and a pressure ratio of the centrifugal compressor;

(H) opening the exhaust valve to discharge the compressed gas when a surge prevention controller determines that the monitored operating point of the centrifugal compressor is positioned on a lower side, in the flow rate, of the first surge prevention line set by the surge prevention controller;

(I) shifting the first surge prevention line toward the set surge line at a shift cycle so that the first surge prevention line gradually approaches the set and stored surge line; and (J) when determining that surging has occurred, shifting the first surge prevention line to a larger side in the flow rate as a second surge prevention line, and wherein the steps (A) to (J) are performed by the surge prevention controller, and the operating point, the surge line, and the first and second surge prevention lines are expressed in a two-dimensional coordinate system including a coordinate axis of the calculated flow rate and a coordinate axis of the calculated pressure ratio.

8. The method of preventing surging according to claim 7, further comprising the steps of:

(K) storing operation data of the centrifugal compressor for a constant time at a constant cycle; and (L) obtaining operation data of a surging occurrence point by referring to operation data at a time point traced back from a time point at which it is determined that surging has occurred.

9. The method of preventing surging according to claim 8, further comprising the steps of:

(M) storing the operation data of the surging occurrence points in a database; and (N) updating a surge line of the centrifugal compressor on the basis of the database.

* * * * *